US010145647B2

(12) United States Patent
Iwasawa

(10) Patent No.: US 10,145,647 B2
(45) Date of Patent: Dec. 4, 2018

(54) MULTI-BULLET SHOOTING ELECTRIC GUN

(71) Applicant: TOKYO MARUI CO, LTD., Tokyo (JP)

(72) Inventor: Iwao Iwasawa, Tokyo (JP)

(73) Assignee: TOKYO MARUI CO., LTD., Tokyo (JP)

( * ) Notice: Subject to any disclaimer, the term of this patent is extended or adjusted under 35 U.S.C. 154(b) by 0 days.

(21) Appl. No.: 15/560,543

(22) PCT Filed: Mar. 24, 2015

(86) PCT No.: PCT/JP2015/058934

§ 371 (c)(1),
(2) Date: Sep. 22, 2017

(87) PCT Pub. No.: WO2016/151763

PCT Pub. Date: Sep. 29, 2016

(65) Prior Publication Data

US 2018/0112948 A1 Apr. 26, 2018

(51) Int. Cl.
*F41B 11/646* (2013.01)
*F41B 11/73* (2013.01)
(Continued)

(52) U.S. Cl.
CPC ..... *F41B 11/646* (2013.01); *F41B 11/643* (2013.01); *F41B 11/71* (2013.01); *F41B 11/73* (2013.01)

(58) Field of Classification Search
CPC ..... F41B 11/64; F41B 11/642; F41B 11/646; F41B 11/71; F41B 11/723; F41B 11/73; F41A 21/06; F41A 21/08
See application file for complete search history.

(56) References Cited

U.S. PATENT DOCUMENTS 1,478,597 A * 12/1923 Bebler ..... F41B 11/00 124/48
2,633,119 A * 3/1953 Bauderer ..... F41B 7/08 124/27

(Continued)

FOREIGN PATENT DOCUMENTS

| | | |
|---|---|---|
| JP | 03-221793 | 9/1991 |
| JP | 2000-295379 | 10/2000 |
| JP | 2013-076526 | 4/2013 |
| JP | 2013-083403 | 5/2013 |

OTHER PUBLICATIONS

International Search Report dated Jun. 16, 2015.

*Primary Examiner* — Derrick R Morgan
(74) *Attorney, Agent, or Firm* — Jacobson Holman, PLLC

(57) ABSTRACT

An electric gun having a plurality of barrels includes a plurality of cylinders each of which serves as a compressed air generating unit, and positioned at rear portions of the plurality of barrels, each of which has an air-blast nozzle at a tip end, and a reciprocating piston; a piston assembly with a plurality of pistons which respectively reciprocate inside the cylinders and generate compressed air, binds the plurality of pistons in one place by using a joint portion at the rear, and is integrally provided with one piston shaft, having a rack along a reciprocating direction and the joint portion; and an electric mechanism that causes the piston assembly to retract, causes an elastic member to accumulate pressure, and drives an output gear meshing with the rack in order to compress air by releasing the accumulated pressure.

4 Claims, 12 Drawing Sheets

(51) Int. Cl.

| | |
|---|---|
| ***F41A 21/06*** | (2006.01) |
| ***F41B 11/71*** | (2013.01) |
| ***F41B 11/643*** | (2013.01) |

(56) References Cited

U.S. PATENT DOCUMENTS

| | | | | |
|---|---|---|---|---|
| 5,738,079 | A * | 4/1998 | Keller | F41B 11/642 124/66 |
| 6,067,975 | A * | 5/2000 | Ginn | F41B 11/64 124/59 |
| 8,517,005 | B2 * | 8/2013 | Chu | F41B 8/26 124/56 |
| 9,115,954 | B1 * | 8/2015 | Corsi | F41C 7/02 |
| 2005/0183709 | A1 * | 8/2005 | Marsac | F41B 11/57 124/63 |
| 2007/0144506 | A1 * | 6/2007 | Sun | F41B 11/642 124/67 |
| 2007/0289586 | A1 * | 12/2007 | Tsurumoto | F41B 11/55 124/73 |
| 2008/0229642 | A1 * | 9/2008 | Hu | F41B 11/64 42/54 |
| 2010/0065032 | A1 * | 3/2010 | Yang | F41B 11/57 124/27 |
| 2011/0283984 | A1 | 11/2011 | Hu | |
| 2014/0305419 | A1 * | 10/2014 | Liao | F41B 11/721 124/73 |
| 2015/0059724 | A1 * | 3/2015 | Yang | F41B 11/646 124/66 |

* cited by examiner

MULTI-BULLET SHOOTING ELECTRIC GUN

TECHNICAL FIELD

The present invention relates to an electric gun having a plurality of barrels and including an electric-type compressed air generating unit which blasts a bullet with air in order to shoot each bullet from each of the barrels.

BACKGROUND ART

There are various types of guns classified as simulation guns, which have been changing during leisure pursuits. The change is considered to be accompanied by results that the simulation guns are very safe for not using gunpowder and development of the simulation guns of high quality and high precision is evaluated. As a means for complementing real guns, the simulation guns are in wide use for the purpose of drills and the like in police and the Self-Defense Forces. As simulation guns suitable for this purpose, there are gas guns using compressed gas, air guns using compressed air generated by a piston cylinder mechanism, and the like. The air guns include electric guns operated by an electric mechanism in addition to manually operated guns.

An object of the present invention is to further enhance the function of such simulation guns and particularly is to provide a simulation gun which can shoot bullets in succession from a plurality of barrels. A simulation gun itself, shooting bullets from the plurality of barrels, is already known. However, in the related art, the simulation guns shooting bullets from the plurality of barrels have depended only on manual operation. The inventions of JP-A-2013-83403 and JP-A-2013-76526 are examples which relate to a multi-bullet shooting apparatus. Such simulation guns require a preparation operation (cocking) for a percussion operation every shooting and are not suitable for shooting in succession.

In contrast, the electric guns employ a method in which air is compressed by using a piston cylinder apparatus and the compressed air causes bullets to be shot from a plurality of barrels. However, in a case of such a method, there is a problem in that shooting power can be changed relatively easy. For example, in a case where remodeling is performed such that any one of the insides of the plurality of barrels is clogged, all the compressed air is concentrated in the remaining barrels. In a case of using bullets of 6 mm, that is, so-called airsoft pellets, the simulation gun is regulated by the regulations such as Article 1-2 in the Firearms and Swords Control Act prohibiting kinetic energy at a particular point of measurement from exceeding 3.5 J/cm$^2$. However, in a case where such remodeling is performed, it is not possible to affirm that the energy of the bullets shot from the remaining barrels do not exceed the regulated value.

Electric guns which are simulation guns employing the electric mechanism have been improved based on the invention relating to an automatic air gun that is disclosed in JP-A-3-221793 (JP-B-7-43238) and is developed by the applicant of this application. Originally, the electric guns of such a type are developed in order to allow bullets to be shot in succession, and from the first, the configuration is based on an idea of shooting in succession, that is, sequentially shooting bullets. Therefore, the so-called electric guns always shoot one bullet in succession. A commonly accepted idea that the electric guns adamantly shoot one bullet in succession is prevalent among manufacturers and users, the idea has never been considered to be applied to the multi-bullet shooting apparatus.

CITATION LIST

Patent Literature

[PTL 1] JP-A-2013-83403
[PTL 2] JP-A-2013-76526
[PTL 3] JP-A-3-221793

SUMMARY OF INVENTION

Technical Problem

The present invention has been made in consideration of the foregoing circumstances, and an object thereof is to provide an electric gun having a successive multi-bullet shooting function which enables the electric gun to successively shoot a plurality of bullets without requiring a cocking operation. In addition, another object of the present invention is to be able to shoot the bullets from a plurality of barrels under the same pressure at all times while complying with the regulations of the so-called Guns and Swords Act.

Solution to Problem

In order to attain the above-described objects, according to the present invention, there is provided means for an electric gun having a plurality of barrels and including an electric-type compressed air generating unit which blasts a bullet with air in order to shoot each bullet from each of the barrels. The electric gun includes a cylinder assembly configured to have a plurality of cylinders each of which serves as the compressed air generating unit, which are each positioned at rear portions of the plurality of barrels, each of which has an air-blast nozzle at a tip end, and in each of which a piston reciprocates; a piston assembly configured to have a plurality of the pistons which respectively reciprocate inside the cylinders and generate compressed air, to bind the plurality of pistons in one place by using a joint portion at the rear, and to be integrally provided with one piston shaft having a rack in a reciprocating direction and the joint portion; and an electric mechanism configured to cause the piston assembly to retract, to cause an elastic member to accumulate pressure, and to drive an output gear meshing with the rack in order to compress air by releasing the accumulated pressure.

The electric gun according to the present invention shoots bullets from the plurality of barrels. Basically, one bullet is shot from each one of the barrels at a time. That is, the basic point of shooting one bullet from one barrel is in common with the cases of electric guns in the related art. However, it is possible to change the number of bullets to be loaded in the barrels, as disclosed in the invention of JP-A-2013-83403. Therefore, when the configuration is applied to the present invention, it is technically possible to shoot a plurality of bullets from one barrel.

The electric gun according to the present invention includes the electric-type compressed air generating unit for blasting each bullet with air. As the compressed air generating unit, the present invention includes the cylinder assembly, the piston assembly, and the electric mechanism. The cylinder assembly and the piston assembly are combined and configure the piston cylinder mechanism, and the electric mechanism drives the piston assembly.

The cylinder assembly is constituted by the plurality of cylinders which are each positioned at rear portions of the plurality of barrels, in each of which the piston reciprocates, and each of which has the air-blast nozzle at the tip end. As an apparatus of the present invention, it is preferable that the cylinder assembly is configured to have the plurality of cylinders, a front fixing member fixing each of the cylinders to a tip end portion, and a rear fixing member fixing each of the cylinders to a rear end portion. It is preferable that the air-blast nozzle is provided in the front fixing member, and an insertion port for the piston is open in the rear fixing member.

The piston assembly is configured to have the plurality of pistons which respectively reciprocate inside the cylinders and generate compressed air, to bind the plurality of pistons in one place by using the joint portion at the rear, and to be integrally provided with one piston shaft having the rack along the reciprocating direction and the joint portion. Accordingly, the plurality of pistons are caused to reciprocate by one piston shaft. Since the pressures generated inside the plurality of cylinders are independent from each other and are approximately uniform at all times, even if any one of the barrels is clogged, there is no change in pressure of the remaining barrels.

The cylinder assembly is configured to have a plurality of pipe members, a front fixing member fixing each of the pipe members to a tip end portion, and a rear fixing member fixing each of the pipe members to a rear end portion. According to the configuration, the air-blast nozzle is provided in the front fixing member, and the insertion port for the piston is open in the rear fixing member. Thus, it is possible to easily form the cylinder assembly by using the pipe member, the front fixing member, and the rear fixing member.

It is preferable to have a disposition configuration in which a piston cylinder mechanism is constituted by three sets such that the three sets are combined in the piston assembly by being disposed in a close-contact manner so as to have a triangle shape when seen from the front, the piston shaft is disposed via the joint portion with a positional relationship of being shifted downward from a central portion of the three sets, and the rack is positioned at the top of a part which is shifted downward. When the piston shaft is shifted downward within a range disposed in a triangular manner when seen from the front, it is possible to provide a configuration of meshing with the rack at the top of the part which is shifted downward.

In addition, it is desirable that the electric gun further includes an inter-nozzle configured to be connected to a cartridge portion and the air-blast nozzle. The inter-nozzle is slidable with respect to the air-blast nozzle in an air-tight manner and is integrally provided with a nozzle base which engages with a piston shaft and retracts. The nozzle base has an engagement portion opening a bullet supply passage in response to the retraction, allowing the ballet to move, and then being disengaged, and is caused to advance by biasing means in response to the disengagement such that the bullet is pushed into the cartridge portion through a tip end portion of the inter-nozzle.

BRIEF DESCRIPTION OF DRAWINGS

FIG. 4 consists of FIGS. 4A, 4B, and 4C and illustrates the cylinder assembly according to the invention.

FIG. 5 consists of FIGS. 5A and 5B and illustrates the cylinder assembly according to the invention.

FIG. 7 consists of FIGS. 7A and 7B and illustrates the piston assembly according to the invention.

FIG. 10 consists of FIGS. 10A and 10B and illustrates an operation of the multi-bullet shooting electric gun according to the invention.

FIG. 11 consists of FIGS. 11A and 11B and illustrates an operation of the multi-bullet shooting electric gun according to the invention.

FIG. 12 consists of FIGS. 12A and 12B and illustrates an operation of the multi-bullet shooting electric gun according to the invention.

REFERENCE NUMBERS

10 COMPRESSED AIR GENERATING UNIT
11, 12, 13 BARREL
14 CARTRIDGE PORTION
15 SIGHT MECHANISM
16 CONNECTION GASKET
17 TRIGGER
18 SWITCH
19 OUTER BARREL
20 CYLINDER ASSEMBLY
21, 22, 23 CYLINDER
24 BLAST NOZZLE
25 PIPE MEMBER
26 FRONT FIXING MEMBER
27 REAR FIXING MEMBER
28 INTER-NOZZLE
29 NOZZLE BASE
30 PISTON ASSEMBLY
31, 32, 33 PISTON
34 JOINT PORTION
35 PISTON SHAFT
36 RACK
37 ROD
38 SEAL MEMBER

39 GEAR DISPOSITION SPACE
40 ELECTRIC MECHANISM
41 OUTPUT GEAR
42 ELASTIC MEMBER
43 ELECTRIC MOTOR
44 PINION
45 REDUCTION GEAR SET
46 PISTON MOVEMENT PORTION
47 GUIDE GROOVE
48 SELECTOR
49 LATCH MEMBER
50 CARTRIDGE ASSEMBLY
51 MAGAZINE

Advantageous Effects of Invention

Since the present invention is configured and operates as described above, it is possible to provide the electric gun having a successive multi-bullet shooting function which enables the electric gun to successively shoot a plurality of bullets without requiring a cocking operation. In addition, according to the present invention, since the bullets are shot from the plurality of barrels under the same pressure at all times, it is possible to comply with the regulations of the so-called Guns and Swords Act and to provide a high-safety electric gun.

DETAILED DESCRIPTION OF THE INVENTION

Figure 1:
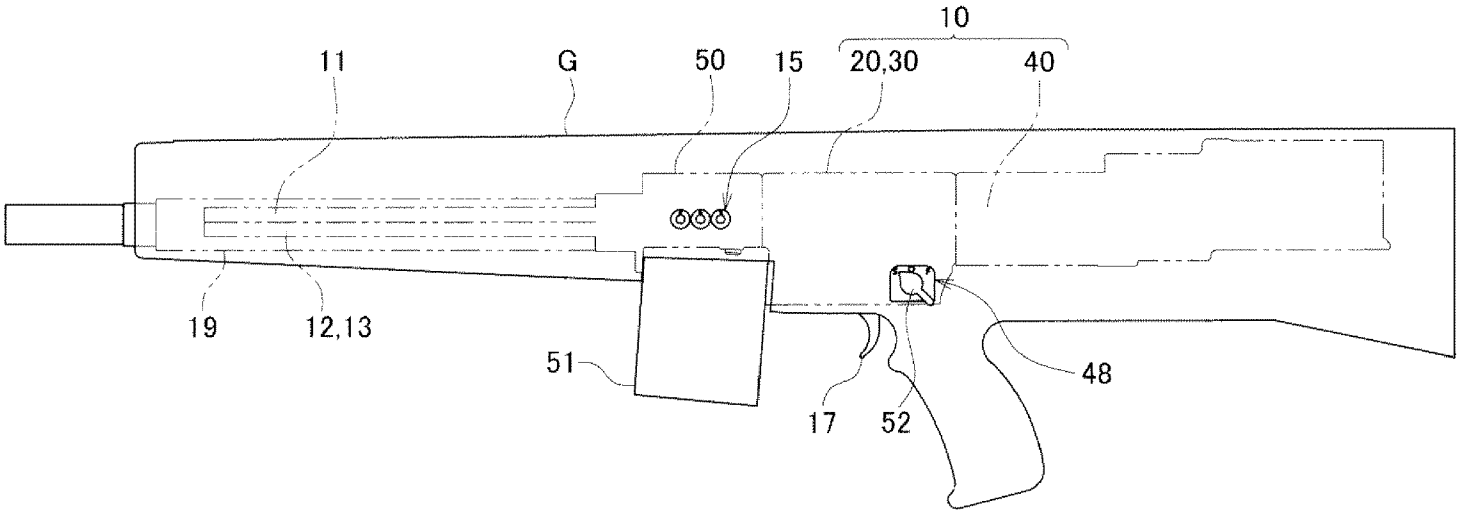
FIG. 1 is a side view illustrating an example of a multi-bullet shooting electric gun according to the invention.
Figure 3:
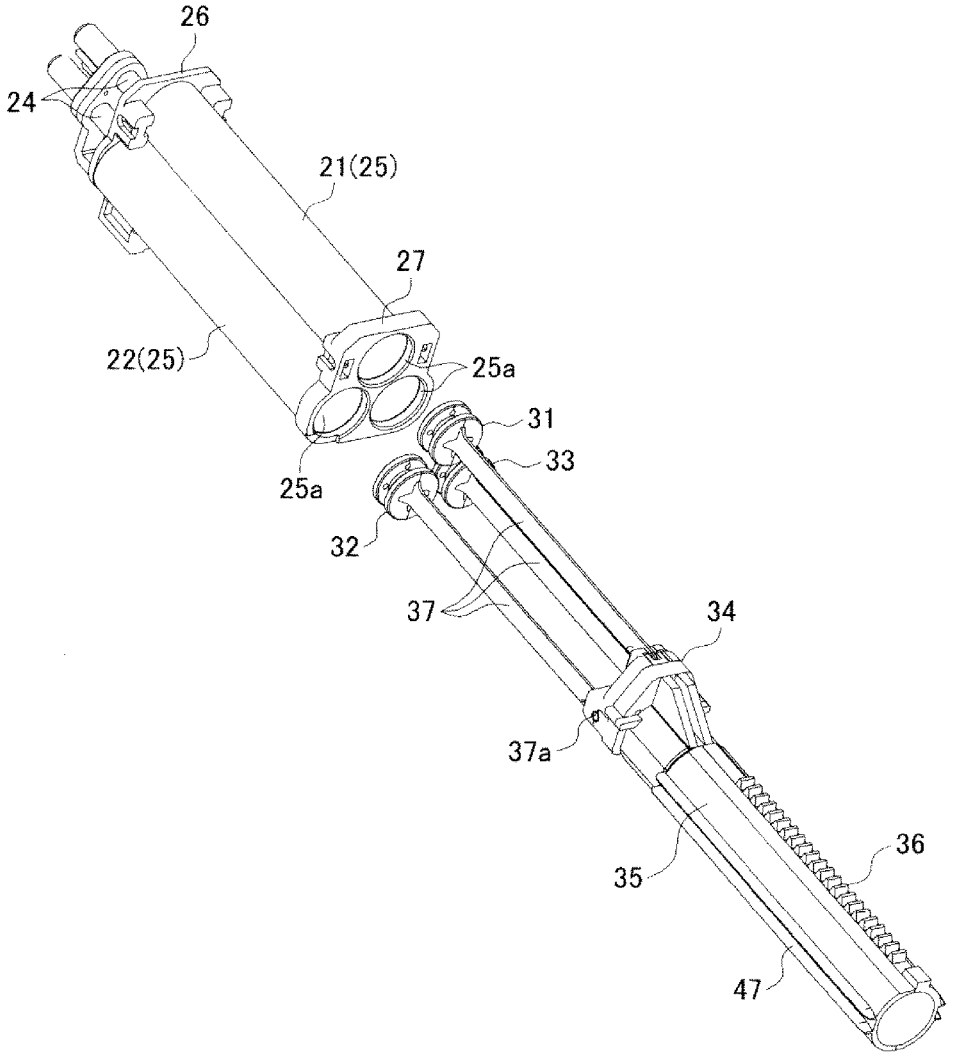
FIG. 3 is an exploded perspective view illustrating a cylinder assembly and a piston assembly according to the invention.

Hereinafter, with reference to an illustrated embodiment, the present invention will be described in more detail. FIG. 1 illustrates a multi-bullet shooting electric gun G according to the present invention including three barrels 11, 12, 13 as an example of a plurality thereof. Therefore, a compressed air generating unit 10 is configured to have a cylinder assembly 20 constituted by three cylinders 21, 22, 23, a piston assembly 30 constituted by three pistons 31, 32, 33, and an electric mechanism 40 driving the piston assembly 30 (refer to FIG. 3 and thereafter).

A cartridge assembly 50 is provided in a rear portion of the barrels, and a detachable magazine 51 is mounted below thereof. A cartridge portion 14 is set in the cartridge assembly 50, so that a bullet B is disposed inside the rear end of each of the three barrels 11, 12, 13. The cartridge portion 14 is provided with a sight mechanism 15 for adjusting a trajectory. In addition, a connection gasket 16 covers the outside of the rear ends of the three barrels 11, 12, 13. The connection gasket 16 is formed of a soft material such as rubber, having seal performance (refer to FIGS. 2 and 6).

The compressed air generating unit 10 is a part generating air with which the bullet B is blasted in order to shoot each bullet B from each of the barrels 11, 12, 13 in the multi-bullet shooting electric gun G. The barrels themselves are combined such that three thereof form a triangle shape when seen from the front. The compressed air generating unit 10 is disposed at the rear inside the electric gun G. The cylinder assembly 20, the piston assembly 30, and the electric mechanism 40 configuring the compressed air generating unit 10 are disposed in an approximately straight line.

Figure 4A:
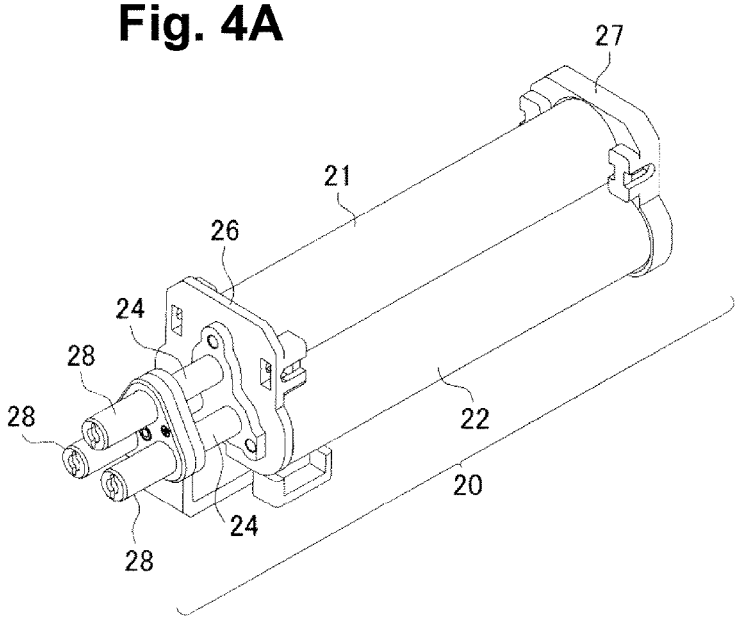
FIG. 4A is a perspective view.
Figure 4B:
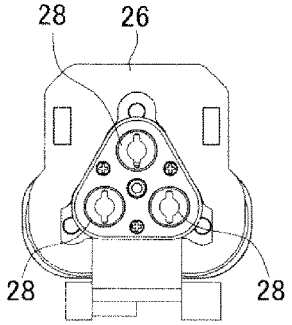
FIG. 4B is a front view.
Figure 4C:
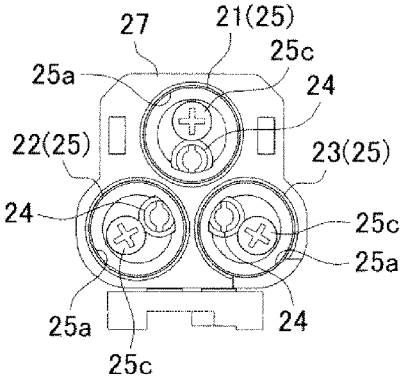
FIG. 4C is a rear view.
Figure 5A:
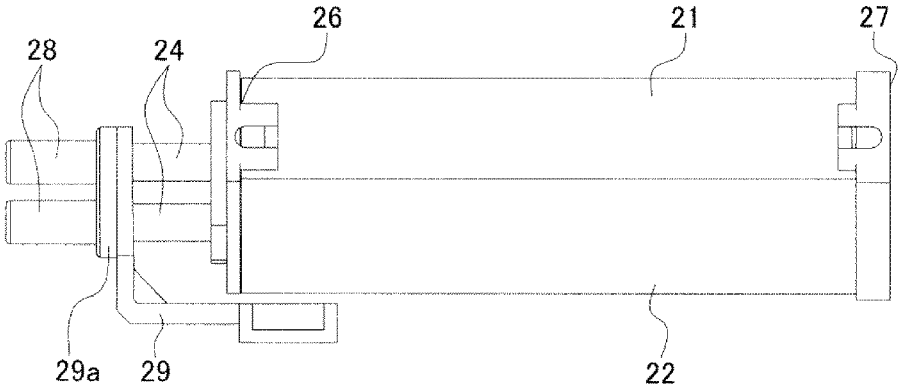
FIG. 5A is a side view.
Figure 5B:
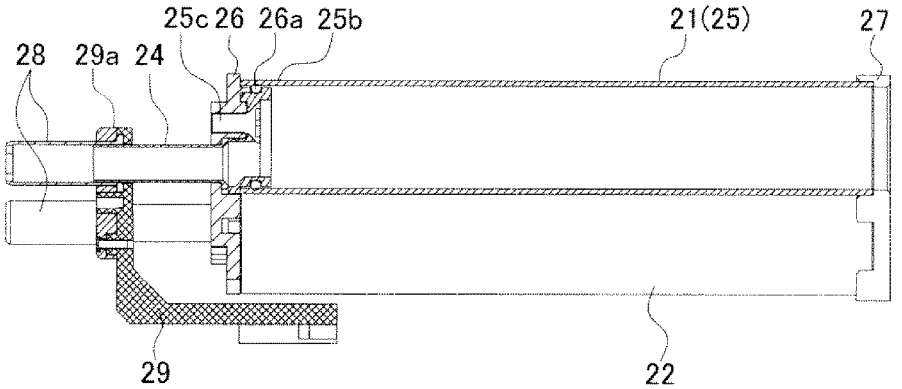
FIG. 5B is a longitudinal sectional view taken along the central line.

The cylinder assembly 20 is positioned in a rear portion of the three barrels 11, 12, 13, has an air-blast nozzle 24 at a tip end, and has the three cylinders 21, 22, 23 in which the pistons 31, 32, 33 respectively reciprocate. The illustrated cylinder assembly 20 is configured to have three pipe members 25, a front fixing member 26 fixing each of the pipe members 25 to a tip end portion, and a rear fixing member 27 fixing each of the pipe members 25 to a rear end portion (refer to FIGS. 3 to 5).

Figure 6:
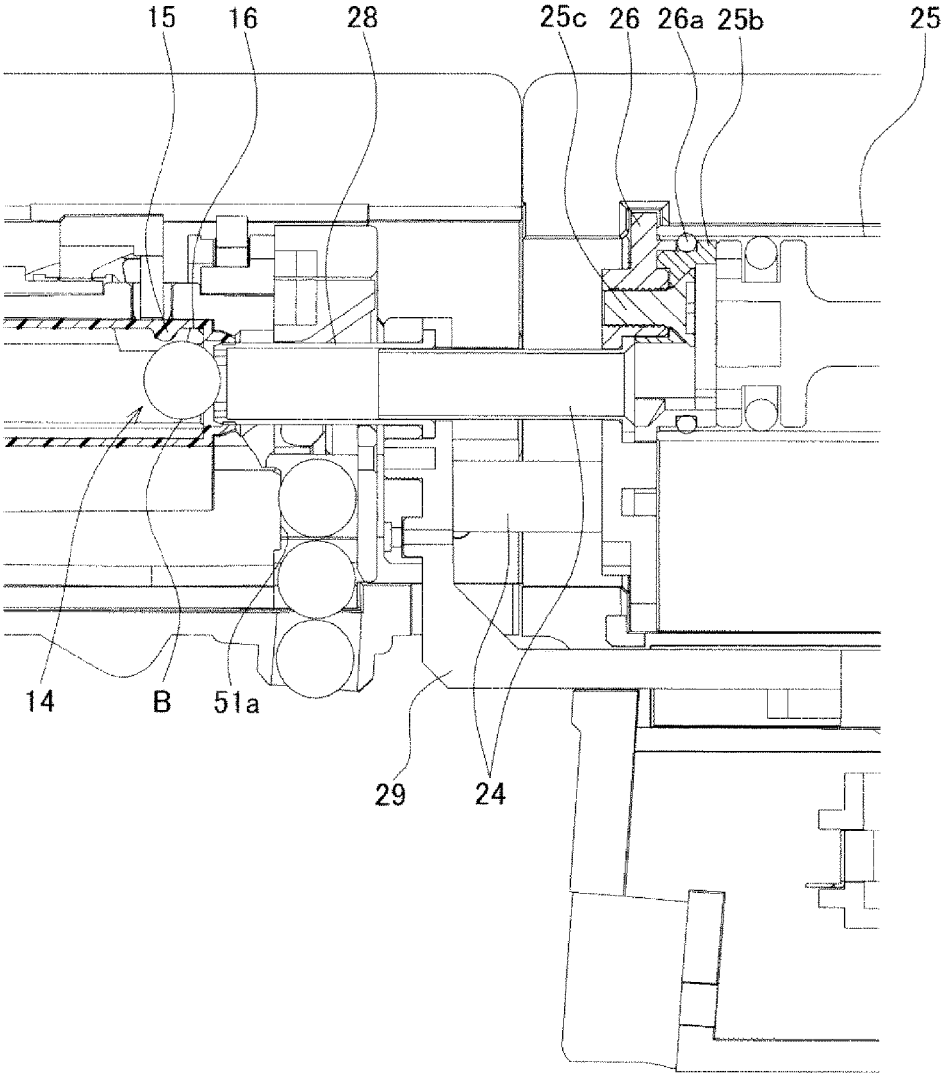
FIG. 6 is a sectional view illustrating a part from the cylinder assembly to a cartridge assembly, according to the invention.
Figure 7A:
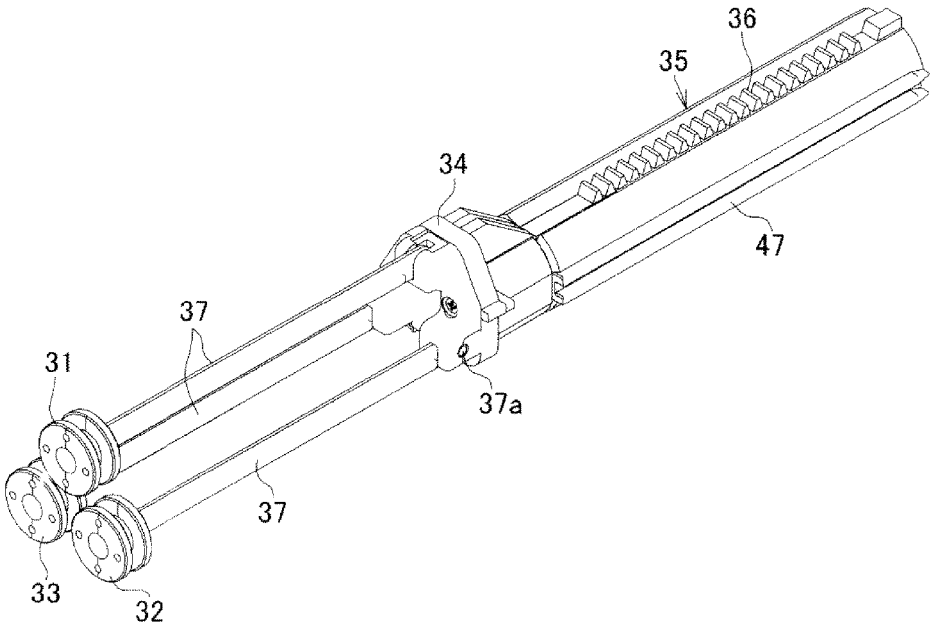
FIG. 7A is a perspective view in its entirety.
Figure 7B:
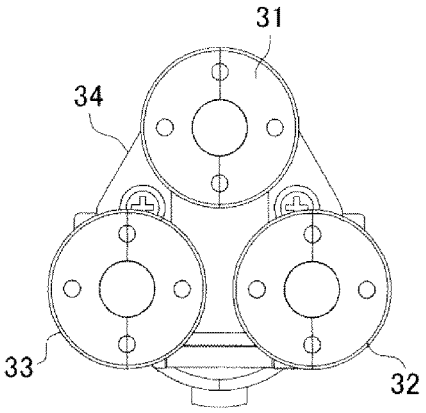
FIG. 7B is a front view.
Figure 8:
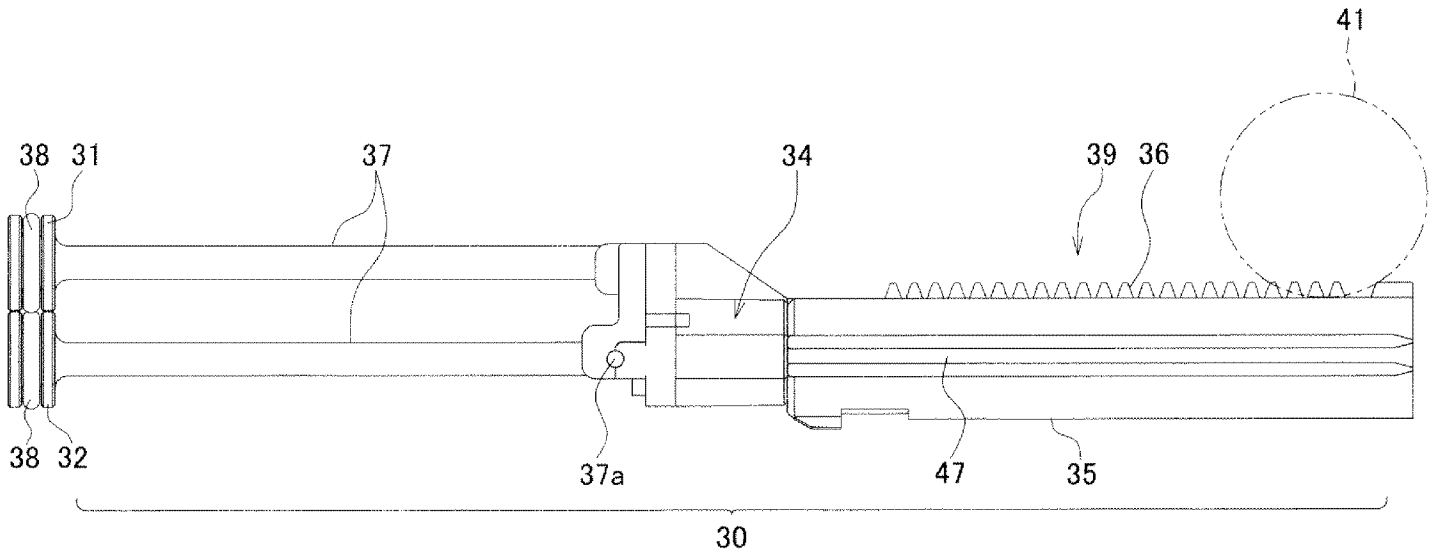
FIG. 8 is a side view illustrating the piston assembly according to the invention.

The air-blast nozzle 24 is provided in the front fixing member 26, and an insertion port 25*a* for the piston is open in the rear fixing member 27. A blast nozzle 24 is provided in front of a pipe attachment member 25*b*, and the pipe attachment member 25*b* is attached to the rear surface of the front fixing member 26 by a fastener 25*c*. The pipe attachment member 25*b* has a positional relationship with the pipe member 25 in which the pipe attachment member 25*b* is fitted, and is assembled in an air-tight manner by using seal means 26*a* (FIG. 6).

As seen in the illustrated embodiment, an inter-nozzle 28 is connected to the cartridge portion 14 and the air-blast nozzle 24 and is provided to be movable in the forward-rearward direction by a nozzle base 29. The inter-nozzle 28 slides with respect to the blast nozzle 24 in an air-tight manner and is at a position where a bullet is blasted with compressed air generated in the compressed air generating unit 10. The inter-nozzle 28 is attached to an erected portion 29*a* of the nozzle base 29 and is incorporated in a main body of the simulation gun G so as to be able to advance and retract.

Figure 2:
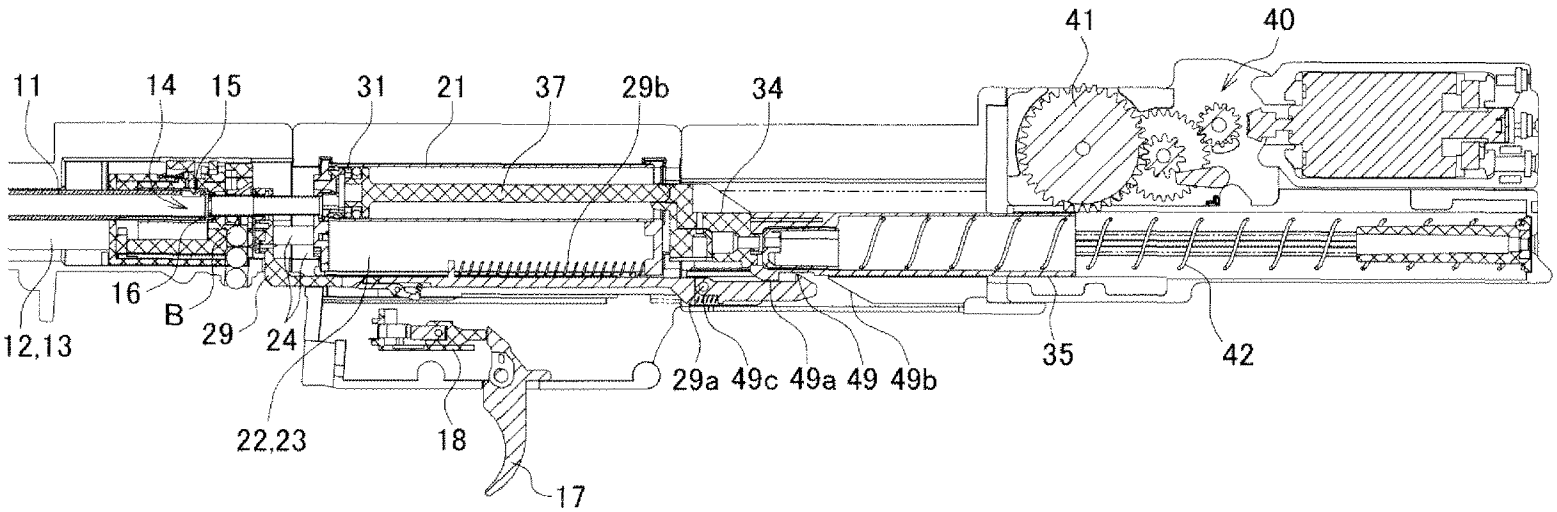
FIG. 2 is a sectional view illustrating an enlarged main portion of the multi-bullet shooting electric gun according to the invention.

Therefore, the inter-nozzle 28 retracts by being engaged with a latch member 49 described below, in response no retract operations of the pistons 31, 32, 33 and is caused to advance by a spring of biasing means 29*b* acting on the nozzle base 29 (refer to FIG. 2). Then, the tip end thereof is configured to also slide with respect to the connection gasket 16 in an air-tight manner, to be separated from the connection gasket 16, and to retract so as to ensure a gap in which the bullet B is pushed up in the rear end portion of the barrel. Thereafter, the inter-nozzle 28 advances so as to push the bullet B into the cartridge portion 14.

The air-blast nozzle 24 is provided at a position leaning to the center of the pipe members 25, 25, 25 of the three cylinders 21, 22, 23. This countermeasure is provided because the air-blast nozzle 24 cannot coincide with the center of a cylinder pipe having a diameter larger than the barrel, since the number of a plurality of the barrels 11, 12, 13 in the illustrated example is three. Thus, the position of the air-blast nozzle 24 is determined based on the relationship between the barrel and the position of the center of the cylinder pipe.

The piston assembly 30 has the three pistons 31, 32, 33 which respectively reciprocate inside the cylinders 21, 22, 23 and generate compressed air. In addition, the three pistons 31, 32, 33 are configured to be bound in one place by a joint portion 34 at the rear and to be integrally provided with one piston shaft 35 having a rack 36 along a reciprocating direction and the joint portion.

The three pistons 31, 32, 33 are flexibly joined to the joint portion 34 such that seal performance between the pistons 31, 32, 33 and cylinder inner wall surfaces is maintained due to the joined state. That is, when the pistons and the cylinders configuring a piston cylinder mechanism have high precision in the positional relationship or the fitting state therebetween, it becomes easy no obtain high compressibility. Moreover, the axial centers therebetween also have to coincide with each other with high precision. However, when a certain degree of flexibility is allowed, it is possible to obtain high compressibility without requiring excessive precision.

In order to apply the flexibility, the present invention employs a configuration in which the pistons 31, 32, 33 are provided at the tip end of a slender rod 37 so as to be movably pivoted by the joint portion 34 at the rear of the rod 37. In the configuration of the illustrated embodiment, the rod 37 is pivoted with respect to the reciprocating direction of the piston by using a pivot 37*a* in the transverse direction such that the rod 37 becomes movable in the vertical direction. The air-tightness of the pistons 31, 32, 33 is maintained by using the illustrated O-rings as seal members 38.

In the configuration of the embodiment in which the piston cylinder mechanism is constituted by three sets, as described above, the three sets are combined in the piston assembly 30 so as to have a triangle shape when seen from the front, the piston shaft 35 is disposed in the joint portion 34 with a positional relationship of being shifted downward from a central portion of the three sets, and the rack 36 is positioned at the top of a part which is shifted downward. Therefore, the position of the rack 36 becomes close to the central portion of the three sets. Accordingly, it is possible to gain a disposition space 39 for the electric mechanism 40 of an output gear 41, and driving force of the output gear 41 is more efficiently transmitted from a position close to the center line.

Figure 9:
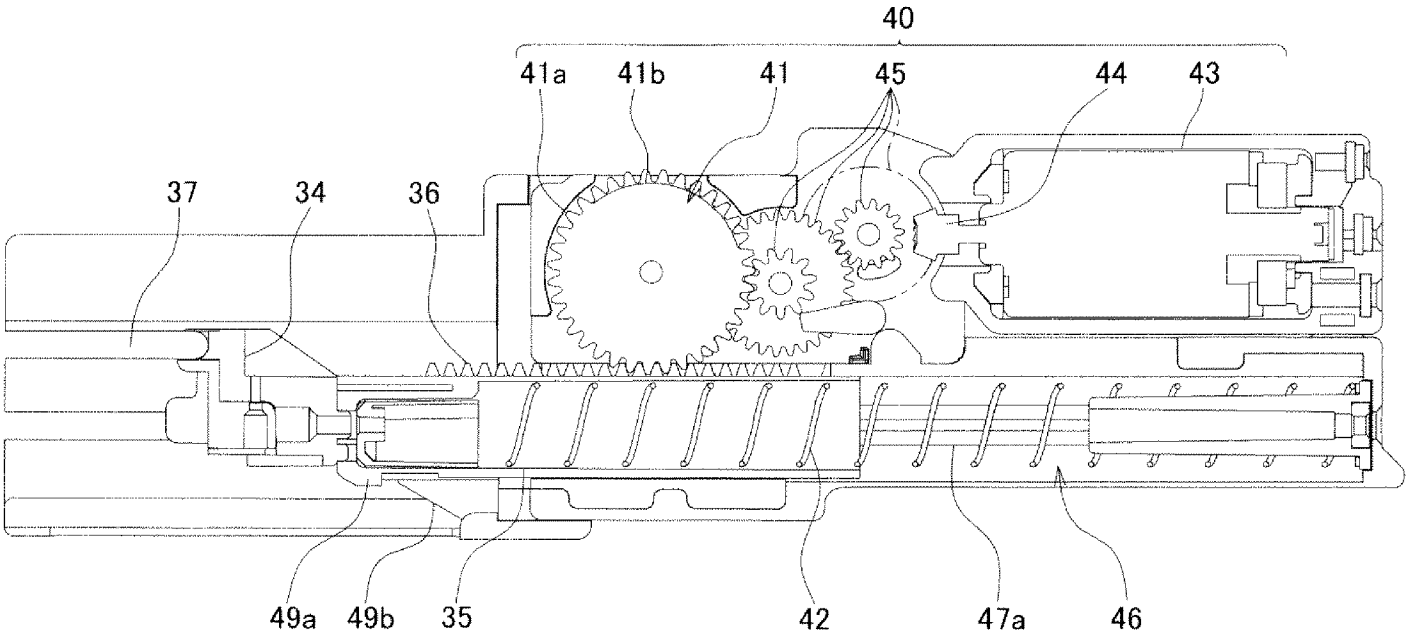
FIG. 9 is an enlarged view illustrating an electric mechanism according to the invention.

The electric mechanism 40 is configured to cause the piston assembly 30 to retract, to cause an elastic member 42 to accumulate pressure, and to drive the output gear 41 meshing with the rack 36 in order to compress air by releasing the accumulated pressure. As a description with reference to FIG. 9 in detail, the reference sign 43 indicates an electric motor, that is, a motor, the reference sign 44 indicates a pinion attached to a rotary shaft thereof, and the reference sign 45 indicates a reduction gear set constituted by several gears meshing with the pinion 44. The output gear 41 is constituted by a sector gear. The sector gear 41 has a toothed portion 41*a* which meshes with the rack 36 and causes the piston assembly 30 to retract, and a non-toothed portion 41*b* which does not mesh with the rack 36 and enables the piston assembly 30 to advance.

The piston shaft 35 has a hollow structure and is biased in the advancing direction by the elastic member 42 illustrated as a coil spring which is hollow inside. One end of the elastic member 42 constituted by the coil spring is in contact with the front end of the piston shaft which is hollow inside, and the other end is supported by the rear end of the cavity which is a movement portion 46 for the piston provided inside the electric mechanism 40. The reference sign 47 indicates a guide portion constituted by an irregular structure. The guide portion 47 is provided in a laterally longitudinal direction of the piston shaft 35 and engages with a projection 47*a* which is an engagement counterpart constituted by an irregular structure provided on the gun main body side, thereby functioning as a guide for moving straight forward (refer to FIG. 9).

In addition to the description above, the multi-bullet shooting electric gun G according to the present invention includes mechanisms required for operating as an electric gun, such as a power source battery (not illustrated), a circuit connecting the power source battery and the electric motor 43, and a switch for turning on/off the power source. The reference sign 18 indicates the switch, the reference sign 19 indicates an outer barrel housing the three barrels, the reference sign 48 indicates a selector for selecting a shooting mode, and the reference sign 49 indicates the aforementioned latch member. The latch member 49 is pivoted at the rear end of the nozzle base 29 by a pivot 29*a* as vertically movable engagement means. The latch member 49 is configured to be retractable by being engaged with an engagement counterpart portion 49*a* provided in the piston shaft 35 and to be able to be disengaged by coming into contact with a disengagement portion 49*b* provided on the gun main body side. The reference sign 49*c* is a spring, which is means biasing the latch member 49 in a direction for engaging with the engagement counterpart portion 49*a* (refer to FIG. 2). The spring 29*b* is configured to act on the nozzle base 29 as forward biasing means so as to push out the supplied bullet B to the cartridge portion 14.

Figure 10A:
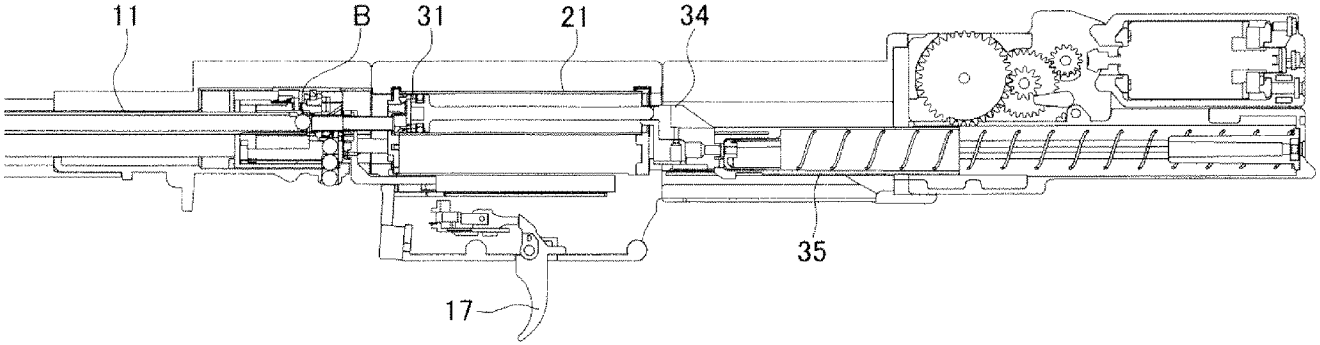
FIG. 10A is a sectional view illustrating a ready-to-shoot state.
Figure 10B:
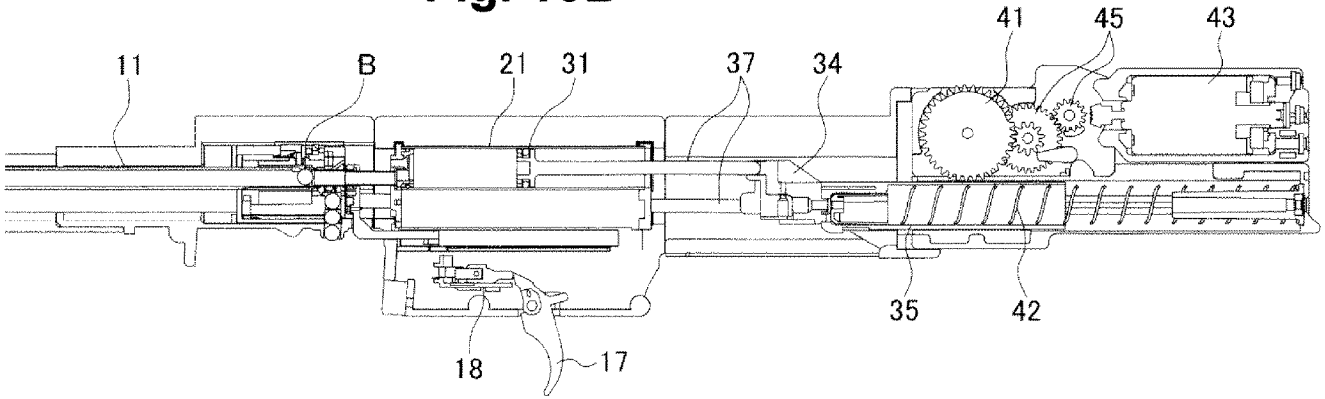
FIG. 10B is a sectional view illustrating a triggered state.

An operation of the multi-bullet shooting electric gun G according to the present invention having such a configuration will be described with reference to FIGS. 10 and 11. FIG. 10A illustrates a standby state where the cartridge portion 14 is loaded with the bullet B and the power source is turned on, that is, a ready-to-shoot state. In this state, the three pistons 31, 32, 33 are at advanced positions respectively inside the cylinders 21, 22, 23 and are at a standstill. When a trigger 17 is pulled, the three pistons 31, 32, 33 can operate. (Only one reference sign for each of the piston 31 and the cylinder 21 is illustrated in FIG. 10A. However, two of the pistons 32, 33 and the cylinders 22, 23 are integrated and operate in the completely same manner.)

When the trigger 17 is pulled, the switch 18 is turned on and the electric mechanism 40 is in an operation state by an electric circuit (not illustrated). Here, when the electric motor 43 operates and the rotary shaft thereof rotates, the output gear 41 at the terminal end starts to rotate via the reduction gear set 45, and the rack 36 meshing with the output gear 41 starts to retract (refer to FIG. 10B). When the three pistons 31, 32, 33 respectively retract inside the cylinders 21, 22, 23, the elastic member 42 starts being compressed in response thereto.

Figure 11A:
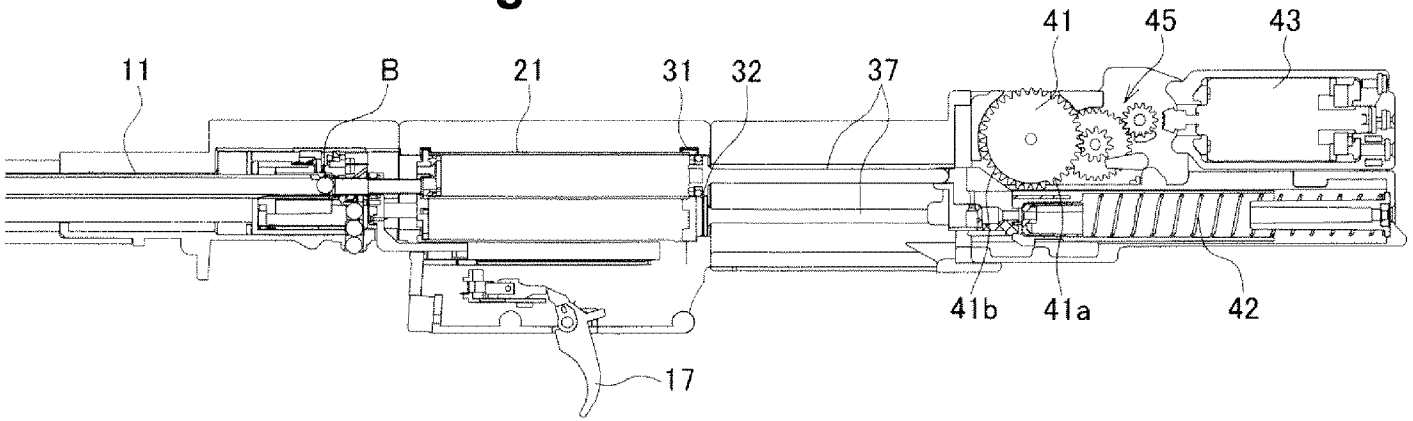
FIG. 11A is a sectional view illustrating the state immediately before a piston is released.

As the rotation of the output gear 41 proceeds, the toothed portion 41*a* and the rack 36 are unmeshed, and a state immediately before thereof is the maximum retraction limit for the three pistons 31, 32, 33. FIG. 11A illustrates a state where the toothed portion 41*a* and the rack 36 are about to be literally unmeshed. In addition, in this state, the elastic member 42 is in a pressure accumulated state of being compressed to the maximum limit.

Figure 11B:
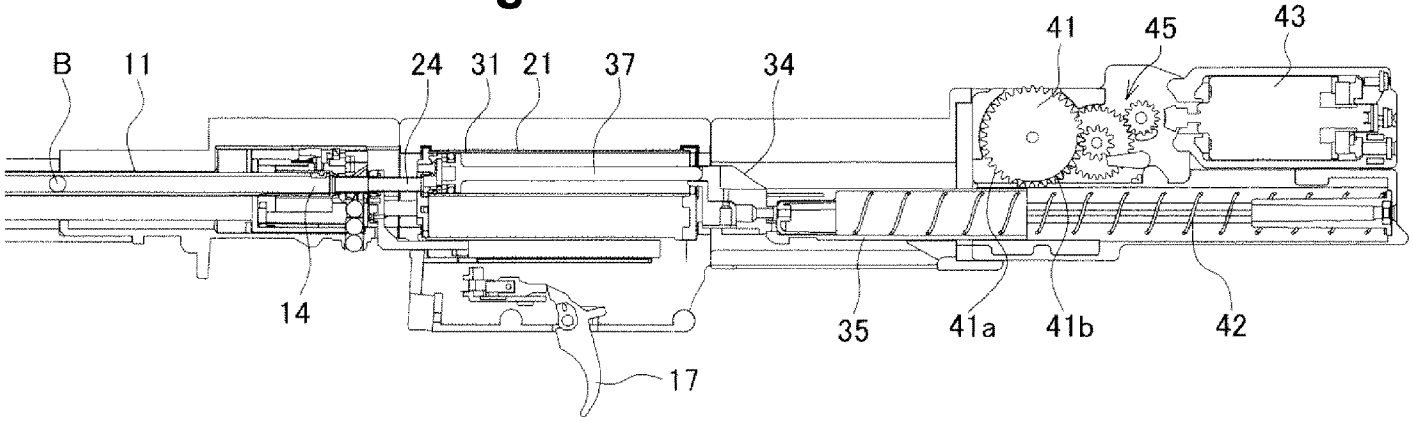
FIG. 11B is a sectional view illustrating the state when a bullet is shot.

When the output gear 41 further rotates and moves to the non-toothed portion 41*b*, the toothed portion 41*a* and the rack 36 are unmeshed, and pressure accumulated in the elastic member 42 is released at once (FIG. 11B). Therefore, the piston assembly 30 instantly switches over to an advance state, and air inside the cylinders 21, 22, 23 is compressed, thereby blasting the three bullets B, B, B with the air from the three blast nozzles 24, 24, 24. As a result, all the bullets B escape from the state of being retained in the cartridge portion 14, move inside the barrels inside, and are shot from, a gun point.

When the three pistons 31, 32, 33 are in the advance state, it is important that the axial center does not tilt with respect to the cylinders 21, 22, 23. In a case of the piston cylinder mechanism in the present invention, in the three pistons 31, 32, 33, each of the rods 37 is flexibly joined to the joint portion 34 by the pivot 37*a*. Therefore, seal performance between all the pistons 31, 32, 33 and the cylinder inner wall surface is maintained. Thus, the seal members 38, 38, 38 prevent the leakage and complete compression is performed.

Figure 12A:
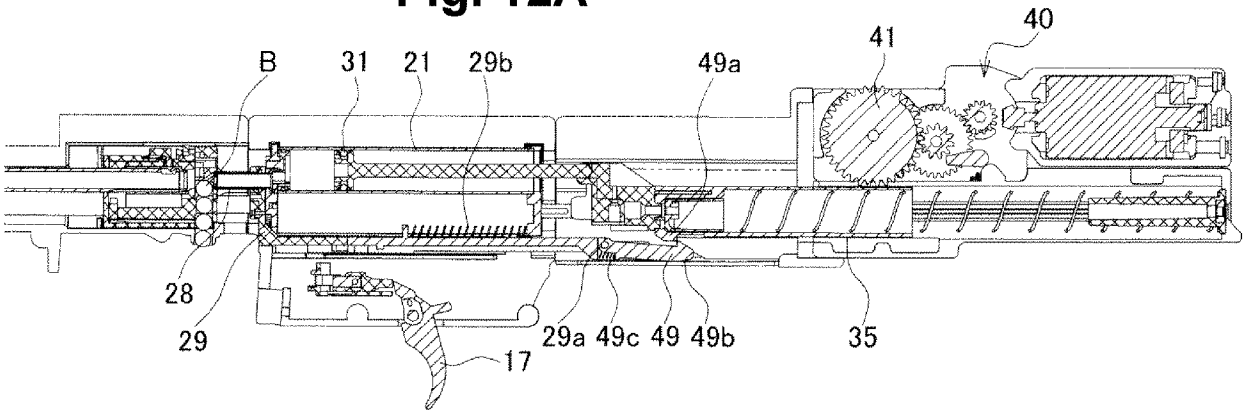
FIG. 12A is a sectional view illustrating the state where an inter-nozzle retracts when a cartridge portion is loaded with a bullet.
Figure 12B:
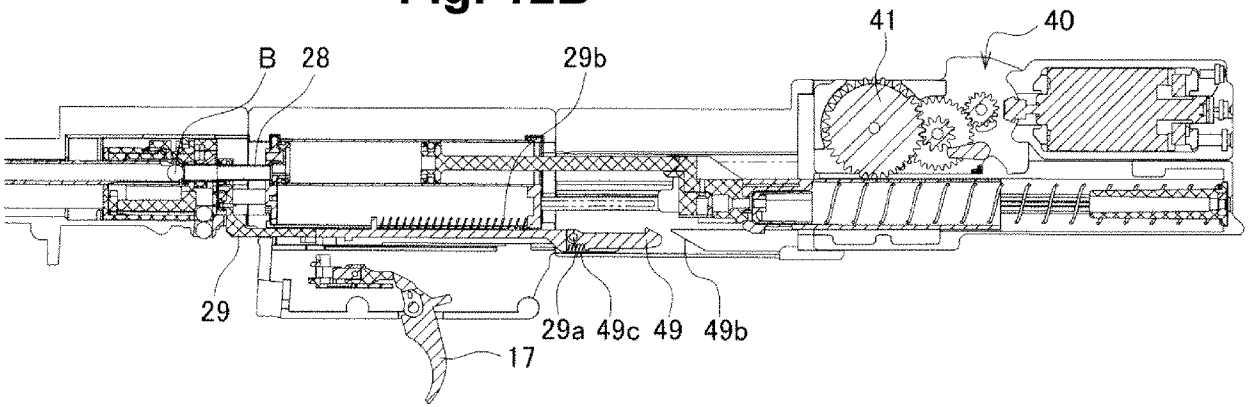
FIG. 12B is a sectional view illustrating the state where the bullet is pushed into the cartridge portion.

FIG. 12 illustrates a state where the cartridge portion 14 is loaded with the bullet B. In FIG. 12, the piston shaft 35 retracts together with the rack 36 which retracts in response to the rotation of the output gear 41. The latch member 49 which is pivotally supported at the rear end of the nozzle base 29 moves rearward in an inter-connected manner by being engaged with the engagement counterpart portion 49*a*. When the inter-nozzle 28 retracts together with the retracting nozzle base 29, a supply passage 51*a* is open such that the magazine 51 communicates with the cartridge portion 14 (FIG. 12A). Then, one shot of the bullet B is pushed out by the pressure supplied from the magazine 51 (refer to FIG. 6). When the inter-nozzle 28 retracts by a predetermined distance, the inter-nozzle 28 comes into contact with the disengagement portion 49*b* at the rear, is disengaged from the engagement counterpart portion 49*a*, and stops retracting. Then, the inter-nozzle 28 switches over to the advance state due to repulsive force of the spring which is the biasing means 29*b* acting on the nozzle base 29. As a result, the bullets B is supplied to the loading portion 14 one shot at a time (FIG. 12B).

The present invention is configured as described above. Even if remodeling is performed such that any one of the insides of the plurality of barrels is clogged, all the compressed air is not concentrated in the remaining barrels. In a case of using bullets of 6 mm regulated for simulation guns, the configuration complies with the regulations such as Article 1-2 in the Firearms and Swords Control Act prohibiting kinetic energy at a particular point of measurement from exceeding 3.5 J/cm$^2$. Then, it is possible to overturn a commonly accepted idea that so-called electric guns always shoot one bullet in succession, and thus, it is possible to shoot a plurality of bullets in succession.

The invention claimed is:

1. A multi-bullet shooting electric gun having a plurality of barrels and including a compressed air generating unit which blasts a bullet with air in order to shoot one or more bullets disposed in a cartridge portion of each of the plurality of barrels, the electric gun comprising:

a cylinder assembly configured to have a plurality of cylinders, each of the plurality of cylinders serves as the compressed air generating unit, each of the plurality of cylinders being positioned at rear portions of the plurality of barrels, each of the plurality of cylinders having an air-blast nozzle at a tip end, and a piston reciprocates in each of the plurality of cylinders;

a piston assembly configured to have a plurality of the pistons which respectively reciprocate inside the cylinders to generate compressed air, the plurality of pistons are joined in one place by using a joint portion at the rear, and the joint portion is integrally provided with one piston shaft having a rack; and an electric mechanism configured to cause the piston assembly to retract, the electric mechanism configured to compress an elastic member, and the electric mechanism configured to drive an output gear which meshes with the rack in order to compress air by releasing the compressed elastic member;

wherein the plurality of pistons, each having a rod, are configured to be flexibly joined to the joint portion by a pivot, whereby the rod becomes movable, such that seal performance between the piston and a cylinder inner wall surface is maintained due to the pivot.

2. The multi-bullet shooting electric gun according to claim 1, wherein the cylinder assembly comprises a plurality of pipe members, the plurality of pipe members each comprising a tip end portion and a rear end portion, a front fixing member connecting the tip end portions of the plurality of pipe members, a rear fixing member connecting the rear end portions of the plurality of pipe members, an air blast nozzle is provided through the front fixing member, and the rear fixing member comprises an insert port for receiving the plurality of pistons.

3. The multi-bullet shooting electric gun according to claim 1, wherein the plurality of pistons is three pistons which are configured in close proximity to one another such that the three pistons form a triangular shape when viewed from a barrel end of the gun, the pistons are connected to the piston shaft via the joint portion, the piston shaft is shifted downward from the center of the triangular shape and the rack is positioned on top of the piston shaft.

4. The multi-bullet shooting electric gun according to claim 1, further comprising:

an inter-nozzle disposed between the cartridge portion and the air-blast nozzle, wherein the inter-nozzle is disposed around the air-blast nozzle and is slidable with respect to the air-blast nozzle in an air-tight manner, wherein the inter-nozzle is integrally provided with a nozzle base which engages with the piston shaft and the inter-nozzle is configured to retract with the piston shaft, and wherein the inter-nozzle is configured to open a bullet supply passage in response to retraction of the nozzle base with the piston shaft, allowing the bullet to move into alignment with the cartridge portion, when the nozzle base is disengaged from the piston shaft the bullet is advanced by a biasing means such that the bullet is pushed into the cartridge portion by a tip end portion of the inter-nozzle.

* * * * *